US005133998A

United States Patent [19]

Okazaki et al.

[11] Patent Number: 5,133,998

[45] Date of Patent: Jul. 28, 1992

[54] METHOD OF MANUFACTURING A FIXING ROLLER

[75] Inventors: Hiroshi Okazaki; Chiaki Kato; Masaya Nishi, all of Osaka, Japan

[73] Assignee: Sumitomo Electric Industries, Ltd., Osaka, Japan

[21] Appl. No.: 681,709

[22] Filed: Apr. 8, 1991

[51] Int. Cl.[5] ..... B05D 1/28

[52] U.S. Cl. ..... 427/428

[58] Field of Search ..... 427/428

*Primary Examiner*—Bernard Pianalto

*Attorney, Agent, or Firm*—Cushman, Darby & Cushman

[57] ABSTRACT

A method for manufacturing a roller for use in the image fixing section of a copying machine and the like. The method includes the steps of transferring a coating roller to a fluorine resin dispersion bath, drawing the resin from the bath to the coating roller, and transferring a predetermined amount of resin from the coating roller to a core.

11 Claims, 2 Drawing Sheets

METHOD OF MANUFACTURING A FIXING ROLLER

BACKGROUND OF THE INVENTION

1. Field of the Invention

Fixing rollers are used in the fixing sections of copying machines, line printers, facsimile machines, and the like. This invention is directed to a method for manufacturing fixing rollers.

2. Description of the Related Art

The fixing section of a copying machine is shown in FIG. 3 (PRIOR ART). In a widely employed safe and economical fixing method, a copy sheet 33 on which a toner image 32 has been transferred is passed between a heating/fixing roller 30 and a pressure fixing roller 31. When the sheet 33 passes therebetween, heat and pressure applied to the copy sheet cause the toner image to fuse and fix on the copy sheet.

Heating/fixing roller 30 comprises a roller base member or roller core member 34 made of heat resistant material such as plastic, ceramic or metal. The roller core member 34 is coated with a fluorine resin coating 35 several tens of a micrometer thick for ease in peeling the toner from the surface of the core member.

Pressure/fixing roller 31 includes a core member 36. Core member 36 is coated with a coating 37. A Separation pawl 38 is associated with roller 30 and a separation pawl 39 is associated with roller 31. Reference numeral 40 represents a toner fixed image and reference numeral 41 represents a heater for generating the thermal energy required to fix the toner image 32 to the copy sheet 33.

A resin coating is typically formed on the surface of a tubular core member of a fixing roller by a spray coating method or by an electrostatic coating method. This coating is burnt and provides a rough surface. Accordingly, the surface requires polishing, and, occasionally, further burning.

In the known transfer coating method, a transfer coating roller draws fluorine resin dispersion from a resin dispersion bath onto its spherical outer surface, and applies the resin dispersion over the core member. The surface of the fluorine resin coating, which is formed on the core member by the transfer coating roller and is then burned, is uniform and smooth. Therefore, the polishing and the reburning steps are not required for the surface of the resin coating.

However, the transfer coating method has its disadvantages as well. For example, when the fluorine resin dispersion drawn onto the outer surface of the transfer coating roller is separated from the resin dispersion on the outer surface of the core member, the amount of coating of the resin dispersion is increased wherever the resin dispersions are separated from each other. Thus, the thickness of the resin coating is increased. When the transfer coating method is used, difficulties arise in forming the resin coating uniformly over the entire surface of the core member. In some extreme cases, the difference in thickness across the surface of the roller exceeds 30 μm. When a core member having a resin coating with that large of a thickness gradient is used for the fixing roller of a copying machine, a variety of associated operational difficulties may occur. For example, the fixing of the image is poor. Also, the copy sheet tends to wrinkle. Moreover, A color irregularity or stripe appears on the boundary between the thickness-increased portion of the resin coating and the remaining portion.

SUMMARY OF THE INVENTION

Accordingly, an objective of the present invention is to provide a method of manufacturing a fixing roller having a core member coated with fluorine resin dispersion which is free from the problems as referred to above.

To achieve this objective, the present invention provides a method for coating a circular core member formed from a heat resistant material such as ceramic, plastic, or metal. The core is coated by fluorine resin dispersion using the transfer coating method. A transfer coating apparatus is utilized which includes a drive system for turning a transfer coating roller with a fluorine resin dispersion, a temperature control device, a resin dispersion bath, and a transfer mechanism for transferring a core member. A core member is moved toward the transfer coating roller until the spherical outer surface of the core member reaches a range of positions between the core member and the transfer coating roller. The transfer coating roller draws resin dispersion from a resin dispersion bath. Within the range of positions, the spherical outer surface of the core member can draw a predetermined amount of fluorine resin dispersion from the transfer coating roller. After the resin dispersion is drawn from the transfer coating roller, the distance between the transfer coating roller and the core member is extended to a critical point, at which the resin dispersion contacting both ends of an effective width of coating on the core member begins moving toward the inner side of the core member in a longitudinal direction of the core member. Finally, the core member is separated from the transfer coating roller at a specific speed.

In order to separate the fluorine resin dispersion drawn to the surface of the transfer coating roller from that drawn by the core member, the relative difference in speed between the core member and the transfer coating roller is varied when the core member i separated from the transfer coating roller. This speed variation is performed by altering the number or direction of revolutions of either or both the core member and the transfer coating roller.

By utilizing the fixing roller manufacturing method according to this invention, it is not necessary to polish or re-burn the surface of the resin, as in the prior art. Additionally, the fixing roller manufacturing method can be used to coat uniformly the entire surface with the fluorine resin dispersion.

BRIEF DESCRIPTION OF THE DRAWINGS

A preferred embodiment of a method of manufacturing a fixing roller in accordance with the present invention will be described in detail with reference to the accompanying drawings.

FIG. 1(*a*) is a side view showing an overall apparatus for manufacturing a fixing roller by the fixing roller manufacturing method. FIG. 1(*b*) is a partial side view of the transfer coating. FIG. 1(*c*) is a front view of the main portion of the transfer coating.

DETAILED DESCRIPTION OF THE PREFERRED EMBODIMENTS

Figure 1A:
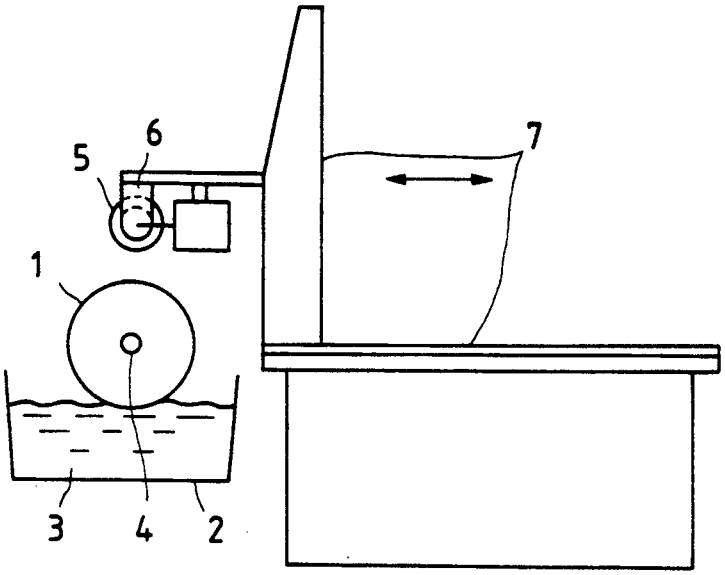
FIGS. 1(*a*), 1(*b*) and 1(*c*) illustrate the method for manufacturing a fixed roller according to this invention. More specifically, the figures show how a transfer coating is performed.
Figure 1B:
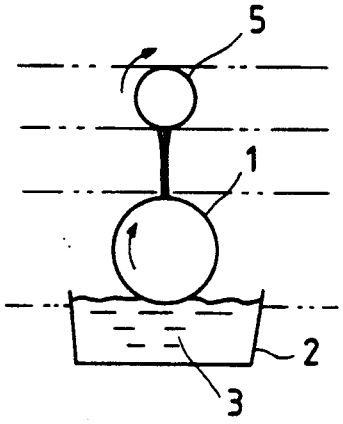
Figure 1C:
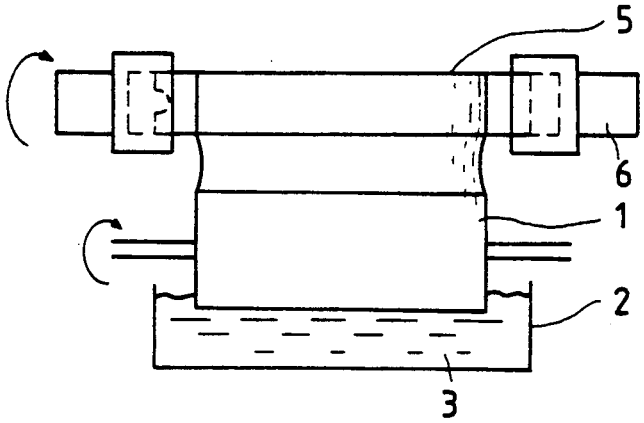

As illustrated in FIGS. 1(*a–c*), a transfer coating roller 1 draws up fluorine resin dispersion 3 from a resin dispersion bath 2. Some of the resin will be coated onto core member 5.

A dispersion temperature control means 4 is provided for keeping the temperature of the resin dispersion constant so that a viscosity thereof may be maintained at a desired value, thereby providing a stable amount of the resin dispersion when the core member is coated.

A drive system 6 turns core member 5 at the appropriate time, and a transfer structure 7 moves core member 5 as needed.

Figure 2:
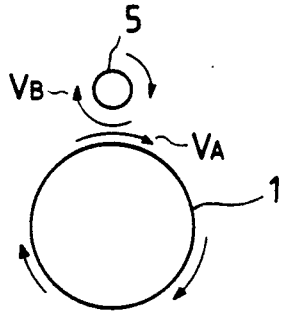
FIG. 2 shows directions of movement of a transfer roller and core member.
Figure 3:
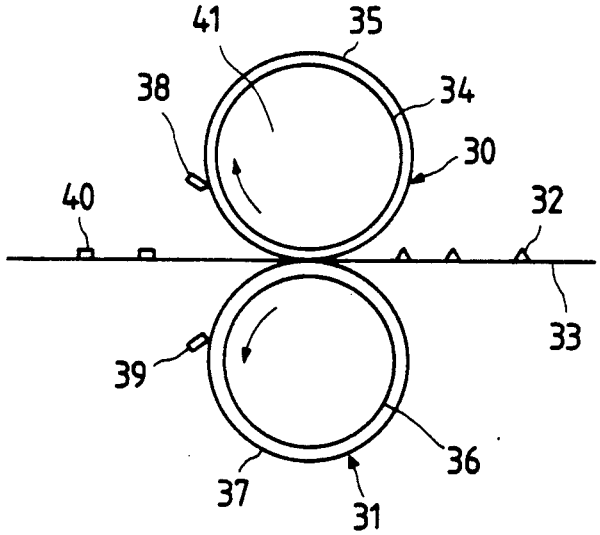
FIG. 3 (PRIOR ART)
FIG. 3 (PRIOR ART) is a side view of a fixing roll in use.

FIG. 2 shows directions of rotation of a transfer roll and core member. The velocity of core member 5 is represented as Va, while the velocity of transfer coating roller 1 is shown as Vb.

When the resin dispersion 2 drawn onto the outer surface of the transfer coating roller 1 is separated from the resin drawn onto core member 5, the thickness of the resin coating partially increases on the outer surface of core member 5. In order to reduce the coating gradient on core member 5 so that it is less than 30 μm, the following method is employed. First, transfer coating roller 1 draws resin dispersion 3 from a resin dispersion bath 2. After this is accomplished, core member 5 is moved toward the transfer coating roller 1 by transfer structure 7 until the spherical outer surface of core member 5 reaches a range of positions between core member 5 and transfer coating roller 1. This range of distances is known as the "gap distance". When it is within the gap distance, the outer surface of core member 5 can draw a desired amount of fluorine resin dispersion 3 which transfer coating roller 1 has already drawn up from dispersion bath 2.

Thereafter, the gap distance is extended by transfer structure 7 up to a critical point, at which the resin dispersion contacting both ends of a longitudinal length of a portion of core member 5, known as the "effective width of coating", begins to move toward the inner side of core member 5 in a longitudinal direction of the core member 5. Finally, core member 5 is further extended away from transfer coating roller 1 until it is separated therefrom by means of transfer structure 7.

When core member 5 is separated from transfer coating roller 1, a difference between a rotational speed of core member 5, Vb, and that of transfer coating roller 1, Va, known as the "relative speed", may be varied. Such variation in relative speed may be accomplished by changing the number of revolutions and the direction of rotation of either or both core member 5 and transfer coating roller 1. By varying the relative speed between core member 5 and transfer coating roller 1 during separation, the separation of the core member 5 from the transfer coating roller 1 is improved, and the resin thickness gradient on core member 5 may be reduced.

Three types of fluorine resin dispersion, having a viscosity that falls within a range from 200 to 300 cp, are utilized: (1) primer dispersion used for increasing an adhesive force of the fluorine resin to the core member; (2) top-layer PTFE applied over the primer layer used for increasing the performance of the fixing roller; and (3) top-layer PFA applied over the primer layer, also for increasing the performance of the fixing roller. The primer dispersion is composed of a high polymeric organic substance comprising 1% or more of the weight thereof, to increase an adhesive force of the fluorine resin to the core member, as well as color pigment, fluorine resin solids content, and surface-active agents for dispersing those compositions into water. The high polymeric organic substance may be any of polyamideimide, polyamide, polyphenylene sulfide, polyether sulfone, and the like. The fluorine resin solids content may be PTFE (polytetrafluoroethylene), PFA (tetrafluoroethyleneperfluoroalkylvinylether copolymer) or a mixture of PTFE and PFA The PTFE is composed of approximately 20 to 70% PTFE of the weight thereof, and 0.2 to 5% of the weight comprising filler used for improving various characteristics of either the resin coating formed, the color pigment, or the surface-active agent used to disperse those compositions into water. The PFA is composed of 20 to 70% PFA of the weight thereof, and surface-active agents for dispersing the PFA into water.

If the fluorine resin dispersion is used for coating a roller without carefully considering and selecting the viscosity thereof, then obtaining a desired thickness of the resin coat becomes difficult. Additionally, when a resin coat thickness gradient occurs on the core member after it is separated from the transfer coating roller, as discussed above, it is difficult to reduce this gradient. Moreover, such a resin coat, after being burned, has a great color irregularity, thus resulting in a poor appearance.

These problems can be solved by selecting the viscosity of the fluorine resin dispersion to be within a range from 10 to 200 cp, and, preferably, to within an even narrower range of 20 to 80 cp. A viscosity of the resin dispersion within this range can be attained by adding viscosity-adjusting liquid, such as water, or by adding a viscosity-adjusting, surface-active agent.

By utilizing the method for separating resin dispersion, and by selecting fluorine viscosity, the resin thickness gradient on the core member may be minimized.

The operation of the method for manufacturing a fixing roller of the present invention will now be discussed.

To begin the operation for manufacturing a fixing roller, transfer coating roller 1 draws resin dispersion 3 from a resin dispersion bath 2. After this is accomplished, core member 5 is moved toward the transfer coating roller 1 by transfer structure 7 until the spherical outer surface of core member 5 is within the gap distance thereof. At this point, the outer surface of core member 5 draws fluorine resin dispersion 3 from transfer coating roller 1.

Thereafter, the gap distance is extended by transfer structure 7 to a critical point, at which the resin dispersion contacting both ends of a longitudinal length of a portion of core member 5, known as the "effective width of coating", begins to move toward the inner side of core member 5. Core member 5 is then extended further away from transfer coating roller 1 until it is separated therefrom by means of transfer structure 7.

When core member 5 is separated from transfer coating roller 1, the relative speed between the two is varied by changing the number of revolutions and the direction of rotation of either or both core member 5 and transfer coating roller 1. By varying the relative speed between core member 5 and transfer coating roller 1 during separation, the separation of the core member 5 from the transfer coating roller 1 is improved, and the resin thickness gradient on core member 5 is reduced.

If the viscosity of the fluorine resin dispersion is set to be in the range from 10 to 200 cp, and, preferably in the more narrow range of 20 to 80 cp, both the resin thickness gradient may be reduced, and the appearance of the roller may be improved.

The following examples are presented to illustrate the benefits derived from employing the preferred modes of the invention.

EXAMPLE 1

Core members each of 25 mm is diameter were used. Fluorine resin dispersions of different viscosities were prepared. Coating conditions, such as the number of revolutions of a transfer coating roller, and that of the core member, were adjusted so as to form desired thick resin coats of the fluorine resin dispersions. In coating the core members with the fluorine resin dispersions, the same conditions were applied for all of the coats of the resin dispersions when the core member was moved apart from the transfer coating roll. Each coating over the core member was burnt at 380° C. for 30 minutes, to form samples for testing. In the test, the resin coating thickness of each resin coating was measured, and the resin thickness difference (calculated as the maximum value of the resin thickness—minimum value of the resin thickness) was used for evaluation of the samples. The conditions when the core member was moved apart from the transfer coating roller, and the evaluation results are shown below in Table 1 (A), (B) and (C).

The compositions of the fluorine resin dispersions as shown were are follows:

| | |
|---|---|
| (A) Primer dispersion: | Polyamide-imide of 1 wt/% or more and PTFE of 20 wt % |
| (B) Top - layer dispersion (PTFE): | Filler of 0.2% or more and PTFE of 50 wt % |
| (C) Top - layer dispersion (PFA): | PFA of 50 wt % |

TABLE 1A

| | Primer dispersion | | | | | | |
|---|---|---|---|---|---|---|---|
| | Sample Nos. | | | | | | |
| Conditions | 1 | 2 | 3 | 4 | 5 | 6 | 7 |
| Viscosity (cp) | 10 | 20 | 50 | 80 | 200 | 250 | 300 |
| No. of revolutions of transfer coating roller (rpm) | 7 | 7 | 7 | 7 | 7 | 7 | 7 |
| No. of revolutions of core (rpm) | 40 | 30 | 20 | 15 | 10 | 10 | 10 |
| Gap distance (μm) | 900 | 900 | 900 | 900 | 900 | 900 | 900 |
| Separating speed of core (mm/min) | 700 | 700 | 700 | 700 | 700 | 700 | 700 |
| Thickness difference (μm) | 8 | 8 | 12 | 15 | 28 | 35 | 48 |

TABLE 1B

| | Top layer dispersion (PTFE) | | | | | | |
|---|---|---|---|---|---|---|---|
| | Sample Nos. | | | | | | |
| Conditions | 1 | 2 | 3 | 4 | 5 | 6 | 7 |
| Viscosity (cp) | 10 | 20 | 50 | 80 | 200 | 250 | 300 |
| No. of revolutions of transfer coating roller (rpm) | 20 | 20 | 20 | 20 | 20 | 20 | 20 |
| No. of revolutions of core (rpm) | 80 | 60 | 40 | 30 | 20 | 15 | 10 |
| Gap distance (μm) | 1200 | 1200 | 1200 | 1200 | 1200 | 1200 | 1200 |
| Separating speed of core (mm/min) | 700 | 700 | 700 | 700 | 700 | 700 | 700 |
| Thickness difference (μm) | 25 | 20 | 15 | 20 | 28 | 37 | 42 |

TABLE 1C

| | Top layer dispersion (PFA) | | | | | | |
|---|---|---|---|---|---|---|---|
| | Sample Nos. | | | | | | |
| Conditions | 1 | 2 | 3 | 4 | 5 | 6 | 7 |
| Viscosity (cp) | 10 | 20 | 50 | 80 | 200 | 250 | 300 |
| No. of revolutions of transfer coating roller (rpm) | 20 | 20 | 20 | 20 | 20 | 20 | 20 |
| No. of revolutions of core (rpm) | 70 | 60 | 50 | 40 | 20 | 15 | 10 |
| Gap distance (μm) | 1500 | 1500 | 1500 | 1500 | 1500 | 1500 | 1500 |
| Separating speed of core (mm/min) | 700 | 700 | 700 | 700 | 700 | 700 | 700 |
| Thickness difference (μm) | 12 | 8 | 15 | 19 | 27 | 34 | 40 |

As can be seen rom each of tables 1A, 1B, and 1C, when the viscosity of each resin dispersion exceeds 200 cp, the resin thickness difference exceeds 30 μm, providing for a bad appearance. When it is less than 10 cp, the resultant resin coating is unfit for use. When the viscosity is within the range from 10 to 200 cp, the resin coating formed is less than 30 μm in thickness, and is in the preferred condition for use. When it is within the range from 20 to 80 cp, the resin thickness is 20 μm or less and the resin coating formed is in even better condition for use.

EXAMPLE 2

Core members each having diameters of 25 mm were used. The viscosities of fluorine resin dispersions were adjusted within a range from 10 to 200 cp. The number of revolutions of the transfer coating roller, and that of the core member, were adjusted to form a desired thickness of the resin coats of the fluorine resin dispersions. The gap distance and the speed at which the core member was separated from the transfer coating roller were also varied. The core members were coated with the resin dispersions. Each coating over the core member was burnt at 380° C. for 30 minutes, to form samples for testing. The test was conducted to evaluate two parameters: the variation of the resin thickness; and the appearance of the resin coating surface.

The two parameters were evaluated in the following manner:

(1) Resin Coating Thickness Variation

Core members we coated with fluorine resin dispersions, and the resultant resin coatings were burnt. The thickness of each resin coating thus formed was measured at a total of 40 locations: 8 locations as viewed in the circumferential direction, and 5 locations as viewed in the axial direction. The thickness variation of each resin coating was calculated by using the following formula:

$$\{(\text{Maximum value of the resin thickness}) - (\text{minimum value of the resin thickness})\}/(\text{average value of the resin thickness}).$$

(2) Appearance of the Coating Surface

Core members were coated with fluorine resin dispersions, and the appearance of each resultant resin coating was observed for evaluation.

In each of the following Tables 2 (A)-(F), the number of revolutions counted for sample numbers 2 and 4 were measured before the core member was separated from the transfer coating roller. The number of revolutions of numbers 6 and 7 when the core member was separated from the transfer coating roller.

TABLE 2A

| | Primarer Dispersion | | | | | | | | | | | | | | | |
|---|---|---|---|---|---|---|---|---|---|---|---|---|---|---|---|---|
| | Sample Nos. | | | | | | | | | | | | | | | |
| Conditions | 1 | 2 | 3 | 4 | 5 | 6 | 7 | 8 | 9 | 10 | 11 | 12 | 13 | 14 | 15 | 16 |
| Core mumber diameter (mmϕ) | 25 | 25 | 25 | 25 | 25 | 25 | 25 | 25 | 25 | 25 | 25 | 25 | 25 | 25 | 25 | 25 |
| Viscosity (cp) | 10 | 10 | 10 | 10 | 20 | 20 | 20 | 20 | 50 | 50 | 50 | 50 | 80 | 80 | 80 | 80 |
| No. of revolutions of transfer coating roller (rpm) | 7 | 7 | 7 | 7 | 7 | 7 | 7 | 7 | 7 | 7 | 7 | 7 | 7 | 7 | 7 | 7 |
| No. of revolutions of core (rpm) | 40 | 40 | 40 | 40 | 30 | 30 | 30 | 30 | 20 | 20 | 20 | 20 | 15 | 15 | 15 | 15 |
| Gap distance (μm) | 300 | 300 | 300 | 300 | 800 | 800 | 800 | 800 | 1000 | 1000 | 1000 | 1000 | 1200 | 1200 | 1200 | 1200 |
| Separating speed of core (mm/min) | 10 | 100 | 1000 | 1500 | 10 | 100 | 1000 | 1500 | 10 | 100 | 1000 | 1500 | 10 | 100 | 1000 | 1500 |
| Resin coating Variation | 0.3 | 0.3 | 0.5 | 0.6 | 0.3 | 0.6 | 0.8 | 0.8 | 0.5 | 0.6 | 0.7 | 0.8 | 0.6 | 0.6 | 0.8 | 1.0 |
| Appearance | good | good | good | good | good | good | good | good | good | good | good | good | good | good | good | good |

TABLE 2B

| | Primarer Dispersion | | | | | | | | |
|---|---|---|---|---|---|---|---|---|---|
| | Sample Nos. | | | | | | | | |
| Conditions | 1 | 2 | 3 | 4 | 5 | 6 | 7 | 8 | 9 |
| Core mumber diameter (mmϕ) | 25 | 25 | 25 | 25 | 25 | 25 | 25 | 25 | 25 |
| Viscosity (cp) | 200 | 200 | 200 | 200 | 10 | 20 | 50 | 80 | 200 |
| No. of revolutions of transfer coating roller (rpm) | 7 | 7 | 7 | 7 | 7 | 7 | 7 | 7 | 7 |
| No. of revolutions of core (rpm) | 10 | 10 | 10 | 10 | 40 | 30 | 20 | 15 | 10 |
| Speed difference (cm/min) | | | | | 42 | 42 | 42 | 42 | 42 |
| Gap distance (μm) | 1500 | 1500 | 1500 | 1500 | 300 | 800 | 1000 | 1200 | 1500 |
| Separating speed of core (mm/min) | 10 | 100 | 1000 | 1500 | 100 | 100 | 100 | 100 | 100 |
| Resin coating variation | 1.0 | 1.1 | 1.3 | 1.5 | 0.2 | 0.5 | 0.5 | 0.5 | 1.0 |
| Appearance | good | good | good | good | good | good | good | good | good |

TABLE 2C

| | Top-layer PTFE | | | | | | | | | | | | | | | |
|---|---|---|---|---|---|---|---|---|---|---|---|---|---|---|---|---|
| | Sample Nos. | | | | | | | | | | | | | | | |
| Conditions | 1 | 2 | 3 | 4 | 5 | 6 | 7 | 8 | 9 | 10 | 11 | 12 | 13 | 14 | 15 | 16 |
| Core mumber diameter (mmϕ) | 25 | 25 | 25 | 25 | 25 | 25 | 25 | 25 | 25 | 25 | 25 | 25 | 25 | 25 | 25 | 25 |
| Viscosity (cp) | 10 | 10 | 10 | 10 | 20 | 20 | 20 | 20 | 50 | 50 | 50 | 50 | 80 | 80 | 80 | 80 |
| No. of revolutions of transfer coating roller (rpm) | 30 | 30 | 30 | 30 | 25 | 25 | 25 | 25 | 15 | 15 | 15 | 15 | 12 | 12 | 12 | 12 |
| No. of revolutions of core (rpm) | 70 | 70 | 70 | 70 | 70 | 70 | 70 | 70 | 60 | 60 | 60 | 60 | 50 | 50 | 50 | 50 |
| Gap distance (μm) | 500 | 500 | 500 | 500 | 700 | 700 | 700 | 700 | 1000 | 1000 | 1000 | 1000 | 1200 | 1200 | 1200 | 1200 |
| Separating speed of core (mm/min) | 10 | 300 | 1000 | 1500 | 10 | 300 | 1000 | 1500 | 10 | 300 | 1000 | 1500 | 10 | 300 | 1000 | 1500 |
| Resin coating variation | 0.1 | 0.2 | 0.2 | 0.2 | 0.3 | 0.3 | 0.5 | 0.7 | 0.5 | 0.5 | 0.7 | 0.9 | 1.0 | 1.0 | 1.1 | 1.2 |
| Appearance | good | good | good | good | good | good | good | good | good | good | good | good | good | good | good | good |

TABLE 2D

| | Top-Layer PTFE | | | | | | | | |
|---|---|---|---|---|---|---|---|---|---|
| | Sample Nos. | | | | | | | | |
| Conditions | 1 | 2 | 3 | 4 | 5 | 6 | 7 | 8 | 9 |
| Core mumber diameter (mmϕ) | 25 | 25 | 25 | 25 | 25 | 25 | 25 | 25 | 25 |
| Viscosity (cp) | 200 | 200 | 200 | 200 | 10 | 20 | 50 | 80 | 200 |
| No. of revolutions of transfer coating | 10 | 10 | 10 | 10 | 30 | 25 | 15 | 12 | 10 |

TABLE 2D-continued

| Conditions | Top-Layer PTFE Sample Nos. 1 | 2 | 3 | 4 | 5 | 6 | 7 | 8 | 9 |
|---|---|---|---|---|---|---|---|---|---|
| roller (rpm) | | | | | | | | | |
| No. of revolutions of core (rpm) | 30 | 30 | 30 | 30 | 70 | 70 | 60 | 50 | 30 |
| Speed difference (cm/min) | | | | | 230 | 190 | 110 | 110 | 110 |
| Gap distance (μm) | 2000 | 2000 | 2000 | 2000 | 500 | 700 | 1000 | 1200 | 2000 |
| Separating speed of core (mm/min) | 10 | 300 | 1000 | 1500 | 300 | 300 | 300 | 300 | 300 |
| Resin coating variation | 1.1 | 1.2 | 1.3 | 1.4 | 0.1 | 0.2 | 0.5 | 0.8 | 1.0 |
| Appearance | good | good | good | good | good | good | good | good | good |

TABLE 2E

| Conditions | Top-layer PFA Sample Nos. 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| Core mumber diameter (mmϕ) | 25 | 25 | 25 | 25 | 25 | 25 | 25 | 25 | 25 | 25 | 25 | 25 | 25 | 25 | 25 | 25 |
| Viscosity (cp) | 10 | 10 | 10 | 10 | 20 | 20 | 20 | 20 | 50 | 50 | 50 | 50 | 80 | 80 | 80 | 80 |
| No. of revolutions of transfer coating roller (rpm) | 25 | 25 | 25 | 25 | 20 | 20 | 20 | 20 | 17 | 17 | 17 | 17 | 15 | 15 | 15 | 15 |
| No. of revolutions of core (rpm) | 80 | 80 | 80 | 80 | 70 | 70 | 70 | 70 | 50 | 50 | 50 | 50 | 40 | 40 | 40 | 40 |
| Gap distance (μm) | 500 | 500 | 500 | 500 | 700 | 700 | 700 | 700 | 1000 | 1000 | 1000 | 1000 | 1500 | 1500 | 1500 | 1500 |
| Separating speed of core member (mm/min) | 10 | 100 | 1000 | 1500 | 10 | 100 | 1000 | 1500 | 10 | 100 | 1000 | 1500 | 10 | 100 | 1000 | 1500 |
| Resin coating variation | 0.2 | 0.2 | 0.3 | 0.3 | 0.3 | 0.4 | 0.5 | 0.5 | 0.4 | 0.4 | 0.6 | 0.8 | 1.2 | 1.2 | 1.3 | 1.3 |
| Appearance | good | good | good | good | good | good | good | good | good | good | good | good | good | good | good | good |

TABLE 2F

| Conditions | Top-Layer PFA Sample Nos. 1 | 2 | 3 | 4 | 5 | 6 | 7 | 8 | 9 |
|---|---|---|---|---|---|---|---|---|---|
| Core mumber diameter (mmϕ) | 25 | 25 | 25 | 25 | 25 | 25 | 25 | 25 | 25 |
| Viscosity (cp) | 200 | 200 | 200 | 200 | 10 | 20 | 50 | 80 | 200 |
| No. of revolutions of transfer coating roller (rpm) | 10 | 10 | 10 | 10 | 25 | 20 | 17 | 15 | 10 |
| No. of revolutions of core (rpm) | 25 | 25 | 25 | 25 | 80 | 70 | 50 | 40 | 25 |
| Speed difference (cm/min) | | | | | 150 | 120 | 115 | 115 | 105 |
| Gap distance (μm) | 2000 | 2000 | 2000 | 2000 | 500 | 700 | 1000 | 1500 | 2000 |
| Separating speed of core (mm/min) | 10 | 100 | 1000 | 1500 | 100 | 100 | 100 | 100 | 100 |
| Resin coating variation | 1.3 | 1.3 | 1.3 | 1.4 | 0.1 | 0.3 | 0.3 | 1.1 | 1.2 |
| Appearance | good | good | good | good | good | good | good | good | good |

From the data presented in Table 2, it is seen that the resin coatings having satisfactory thickness gradients and good appearance can be formed when the viscosity of each fluorine resin dispersion is set within the range of 10 to 200 cp and when the number of revolutions of the transfer coating roller and core member are sent so as to obtain a desired resin thickness. Then, the gap distance and the speed at which the core member is separated from the transfer coating roller are set to be:

| | | |
|---|---|---|
| (1) | Primer dispersion | |
| | Gap distance | 300 to 1500 μm |
| | Lifting speed | 1500 mm/min. or less |

-continued

| | | |
|---|---|---|
| (2) | Top-layer PTFE dispersion | |
| | Gap distance | 500 to 2000 μm |
| | Lifting speed | 1500 mm/min. or less |
| (3) | Top-layer PFA dispersion | |
| | Gap distance | 500 to 2000 μm |
| | Lifting speed | 1500 mm/min. or less |

EXAMPLE 3 AND COMPARISON

In this example, the fluorine resin dispersions used were a primer dispersion and a top-layer PFA dispersion, each having the same compositions as those shown in the example 1. The transfer coating method and the spray coating method were used for coating the core members with the dispersions. The resin coatings formed were burnt. The resin coating formed by the spray coating method was polished for finishing the resin coating surface. The surface roughness of each resin coating, after being burnt, was also measured. The core members with the resin coatings thus coated were assembled as fixing rollers into a copying machine. Then, the copying machine was operated for the respective core members. Soil on a cleaning pad used for the roller core member was observed for evaluation of the resin coatings. The results of the evaluation are as shown in Table 3.

TABLE 3

| | State of Processing | | | Surface | |
|---|---|---|---|---|---|
| | Coating | Polishing | Re-burning | Roughness | Evaluation |
| 1 | Transfer | No | No | 2.0S | ○ |
| 2 | Spray | Yes | Yes | 2.5S | ○ |
| 3 | Spray | Yes | No | 0.5S | X |
| 4 | Spray | No | No | 3.5S | X |

NOTE: In the column of evaluation, ○ indicates that the cleaning pad is clean, and X indicates that it is soiled.

The resin coat formed by the conventional spray coating method, when it is not polished, has a great surface roughness of 3.5S. The resin coat surface was polished to be 0.5 s of the surface roughness; however, minute scratches were observed on the resin coat surface. The evaluation of the cleaning pad indicated that the pad was heavily soiled. Therefore, the resin coat formed by the spray coating method required the polishing and the reburning steps. On the other hand, the resin coating formed by the transfer coating method exhibited satisfactory results without requiring performance of the polishing and the re-burning steps.

It should be understood that the present invention is not limited to the above mentioned embodiment, but may variously be changed and modified within the scope of the invention. For example, the fixing roller manufacturing method of the invention is applicable for any type of roller of which the spherical outer surface is to be coated with fluorine resin dispersion.

What is claimed is:

1. A method for coating a circular core member with fluorine resin dispersion, comprising the steps of:

drawing fluorine resin dispersion from a resin dispersion bath onto a transfer coating roller;

moving the circular core member in the direction of the transfer coating roller;

measuring when the distance between outer surfaces of the transfer coating roller and core member is within a predetermined range;

transferring a predetermined amount of the fluorine resin dispersion from the outer surface of the transfer coating roller to the outer surface of the core member when the core member is within the predetermined range;

extending the distance between the transfer coating roller and the core member to a critical point at which the resin dispersion contacting both ends of an effective width of coating on the core member begins moving toward an inner side of the core member in a longitudinal direction of the core member; and separating the core member from the transfer coating roller.

2. A method according to claim 1, wherein the fluorine resin dispersion has a viscosity within the range from 10 to 200 cp.

3. A method according to claim 1, wherein the step of separating the core member from the transfer coating roller includes the step of varying a relative rotational speed of the core member and the transfer coating roller.

4. A method according to claim 1, wherein the rotating step comprises the step of varying a direction of relative rotation.

5. A method according to claim 1, wherein the fluorine resin is polytetrafluoroethylene (PTFE).

6. A method according to claim 1, wherein the fluorine resin is tetrafluoroethylene-perfluoroalkylvinylether copolymer (PFA).

7. A method according to claim 1, wherein the fluorine resin is a mixture of polytetrafluoroethylene (PTFE) and tetrafluoroethylene-perfluoroalkylvinylether copolymer (PFA).

8. A method according to claim 1, wherein the fluorine resin is a high polymeric organic substance containing polytetrafluoroethylene (PTFE), tetrafluoroethylene-perfluoroalkylvinylether copolymer (PFA) or a mixture of PTFE and PFA.

9. A method according to claim 1, wherein the step of separating is carried out when the distance is within the range of 300 to 1500 μm, and the core member is separated from the transfer coating roller at a speed of less than 1500 mm/min., said distance and speed being utilized when the resin is a primer dispersion having high polymeric organic substance of 1% weight or more.

10. A method according to claim 1, wherein the step of separating is carried out when the distance is within the range of 500 to 2000 μm, and the core member is separated from the transfer coating roller at a speed of less than 1500 mm/min., said distance and speed being utilized when the resin is a top layer dispersion having PTFE of 20–70 wt % in weight, and filler of 0.2–5 wt % in weight.

11. A method according to claim 1, wherein the step of separating is carried out when the distance is within the range of 500 to 2000 μm, and the core member is separated from the transfer coating roller at a speed of less than 1500 mm/min., said distance and speed being utilized when the resin is a top layer dispersion having PFA of 20–70 wt % in weight.

* * * * *